US009482484B2

(12) United States Patent
Barney

(10) Patent No.: US 9,482,484 B2
(45) Date of Patent: Nov. 1, 2016

(54) FIREARM SUPPRESSOR

(71) Applicant: Anthony Barney, Salt Lake City, UT (US)

(72) Inventor: Anthony Barney, Salt Lake City, UT (US)

(73) Assignee: Anthony Barney, Salt Lake City, UT (US)

( * ) Notice: Subject to any disclaimer, the term of this patent is extended or adjusted under 35 U.S.C. 154(b) by 0 days.

(21) Appl. No.: 14/566,288

(22) Filed: Dec. 10, 2014

(65) Prior Publication Data

US 2015/0260473 A1 Sep. 17, 2015

Related U.S. Application Data

(60) Provisional application No. 61/914,269, filed on Dec. 10, 2013.

(51) Int. Cl.
*F41A 21/30* (2006.01)

(52) U.S. Cl.
CPC ..... *F41A 21/30* (2013.01)

(58) Field of Classification Search
CPC ..... F41A 21/00; F41A 21/30; F41A 21/32; F41A 21/325; F41A 21/34; F41A 21/36; F41A 21/38
USPC ..... 89/14.4; 181/223
See application file for complete search history.

(56) References Cited

U.S. PATENT DOCUMENTS 748,157 A * 12/1903 Bouton ..... 181/265
1,427,802 A * 9/1922 Goodwin ..... 181/223
3,409,232 A 11/1968 Cholin
3,500,955 A * 3/1970 Werbell ..... F41A 21/30 181/223
3,748,956 A * 7/1973 Hubner ..... 89/14.4
4,024,791 A 5/1977 Stratman
4,939,977 A * 7/1990 Stroup ..... 89/14.4
4,974,489 A * 12/1990 Fishbaugh ..... 89/14.4
5,029,512 A 7/1991 Latka
5,164,535 A * 11/1992 Leasure ..... 89/14.4
6,374,718 B1 4/2002 Rescigno et al.
6,575,074 B1 * 6/2003 Gaddini ..... 89/14.4
6,752,062 B2 6/2004 Vais
6,796,214 B2 * 9/2004 Hausken et al. ..... 89/14.4
6,899,008 B2 5/2005 Breuer
7,290,475 B2 11/2007 Fluhr
7,308,967 B1 12/2007 Hoel
7,412,917 B2 8/2008 Vais
7,523,581 B1 4/2009 Leutenegger et al.

(Continued)

*Primary Examiner* — Bret Hayes
*Assistant Examiner* — Derrick Morgan
(74) *Attorney, Agent, or Firm* — Thorpe North & Western, LLP

(57) ABSTRACT

A firearm suppressor can comprise a central longitudinal chamber adapted to facilitate passage of a projectile fired from a firearm through the central longitudinal chamber. The firearm suppressor can also comprise an outer chamber disposed radially outward of the central longitudinal chamber, the outer chamber being in fluid communication with the central longitudinal chamber via an opening. The firearm suppressor can further comprise a baffle disposed in the outer chamber and defining a forward portion of the outer chamber and a rearward portion of the outer chamber. The forward portion of the outer chamber can contain the opening such that discharge gases associated with the projectile enter the forward portion of the chamber and are directed backward past the baffle to the rearward portion of the outer chamber where the discharge gases are at least temporarily trapped behind the projectile to reduce or prevent alteration of a trajectory or a speed of the projectile by the discharge gases.

22 Claims, 5 Drawing Sheets

(56) References Cited

U.S. PATENT DOCUMENTS

| | | | | |
|---|---|---|---|---|
| 7,832,323 | B1 * | 11/2010 | Davies | 89/14.4 |
| 7,856,914 | B2 | 12/2010 | Shults et al. | |
| 7,931,118 | B1 * | 4/2011 | Cronhelm | F41A 21/30 181/223 |
| 8,087,337 | B1 | 1/2012 | Cary | |
| 8,087,338 | B1 * | 1/2012 | Hines | F41A 21/36 181/223 |
| 8,104,394 | B2 | 1/2012 | Meyers | |
| 8,104,570 | B2 * | 1/2012 | Miller et al. | 181/223 |
| 8,307,946 | B1 * | 11/2012 | Johnston | 181/223 |
| 8,844,422 | B1 * | 9/2014 | Klett | 89/14.2 |
| 8,875,612 | B1 * | 11/2014 | Klett et al. | 89/14.4 |
| 9,239,201 | B1 * | 1/2016 | Reis Green | F41A 21/30 |
| 2007/0107590 | A1 * | 5/2007 | Silvers | 89/14.4 |
| 2007/0266844 | A1 * | 11/2007 | Dueck | 89/14.4 |
| 2010/0180759 | A1 * | 7/2010 | Petersen | 89/14.4 |
| 2010/0275493 | A1 * | 11/2010 | Polovnev et al. | 42/90 |
| 2011/0132683 | A1 * | 6/2011 | Miller | F41A 21/30 181/223 |
| 2012/0125184 | A1 | 5/2012 | Meyers | |
| 2012/0152093 | A1 * | 6/2012 | Koumbis | 89/14.4 |
| 2012/0167749 | A1 | 7/2012 | Young | |
| 2012/0255807 | A1 * | 10/2012 | Pieratti | F41A 21/30 181/223 |
| 2012/0272818 | A1 * | 11/2012 | Dueck | F41A 21/30 89/14.4 |
| 2012/0291614 | A1 | 11/2012 | Koumbis | |
| 2013/0168181 | A1 * | 7/2013 | Wirth | F41A 21/30 181/223 |
| 2014/0190345 | A1 * | 7/2014 | Daniel et al. | 89/193 |
| 2014/0224574 | A1 * | 8/2014 | Latka | 181/223 |
| 2014/0353076 | A1 * | 12/2014 | Bethlenfalvy | 181/223 |
| 2015/0338183 | A1 * | 11/2015 | Salvador | F41A 21/30 181/223 |

* cited by examiner

FIREARM SUPPRESSOR

RELATED APPLICATIONS

This application claims the benefit of U.S. Provisional Application No. 61/914,269, which was filed on Dec. 10, 2013 and which is incorporated in its entirety herein by reference.

BACKGROUND

Firearms can produce undesirable levels of acoustic noise during use. When using a firearm, for example, it can be desirable to reduce acoustic noise levels because the sound produced by firing the firearm can provide information as to the location of a firearm operator and/or can damage or impair the hearing of the operator or bystanders. To reduce acoustic noise levels, sound reducing devices such as sound suppressors, mufflers, and the like are commonly used.

Suppressors typically operate through diverting gases and energy into chambers surrounding a bore line of the device. A wide variety of chamber designs and baffles have been used to redirect gases. Common suppressor baffles include a series of forward expanding frustoconical shapes which divert a portion of gases away from the bore line. In such devices, discharge gases from the firearm may often advance longitudinally in front of the bullet, which can alter the bullet's speed and/or trajectory.

SUMMARY

Thus, there is a need for a firearm suppressor capable of reducing acoustic noise levels produced by a firearm while having a minimal effect on a speed and/or trajectory of a projectile. Accordingly, a firearm suppressor and associated systems are provided. Such a firearm suppressor can comprise a central longitudinal chamber adapted to facilitate passage therethrough of a projectile fired from a firearm. The firearm suppressor can also comprise an outer chamber disposed radially outward of the central longitudinal chamber, the outer chamber being in fluid communication with the central longitudinal chamber via an opening.

The firearm suppressor can further comprise a baffle disposed in the outer chamber and defining a forward portion of the outer chamber and a rearward portion of the outer chamber. The forward portion of the outer chamber can contain the opening such that discharge gases associated with the projectile enter the forward portion of the chamber and are directed backward past the baffle to the rearward portion of the outer chamber where the discharge gases are at least temporarily trapped behind the projectile to reduce or prevent alteration of a trajectory or a speed of the projectile by the discharge gases.

Furthermore, a firearm suppressor system in accordance with the principles herein can comprise a firearm and a firearm suppressor coupled to or adapted to couple to a muzzle of the firearm. The firearm suppressor can include a central longitudinal chamber adapted to facilitate passage therethrough of a projectile fired from the firearm. The firearm suppressor can also include an outer chamber disposed radially outward of the central longitudinal chamber, the outer chamber being in fluid communication with the central longitudinal chamber via an opening. The firearm suppressor can further include a baffle disposed in the outer chamber and defining a forward portion of the outer chamber and a rearward portion of the outer chamber. The forward portion of the outer chamber can contain the opening such that discharge gases associated with the projectile enter the forward portion of the chamber and are directed backward past the baffle to the rearward portion of the outer chamber where the discharge gases are at least temporarily trapped behind the projectile to reduce or prevent alteration of a trajectory or a speed of the projectile by the discharge gases.

Figure 1:
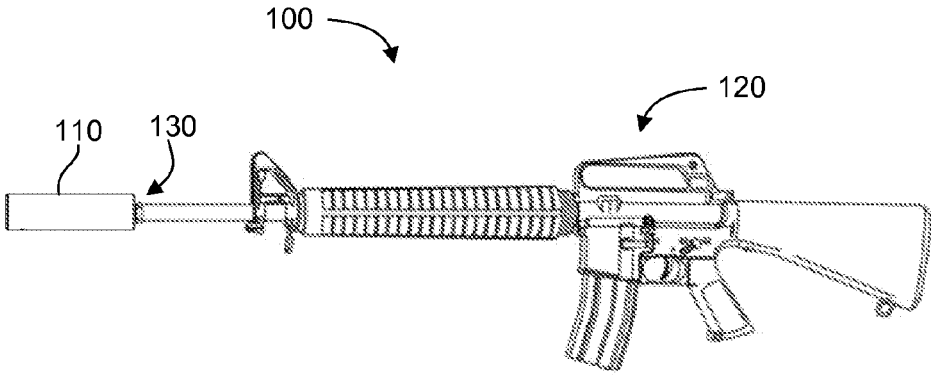
FIG. 1 illustrates a firearm suppressor system including the firearm suppressor mounted on a corresponding firearm, in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth firearm suppressor and associated systems that can reduce acoustic noise levels produced by a firearm while having a minimal effect on a speed and/or trajectory of a bullet or projectile.

With the general embodiments set forth above, it is noted that when describing a firearm suppressor, or the related method, each of these descriptions are considered applicable to the other, whether or not they are explicitly discussed in the context of that embodiment. For example, in discussing the firearm suppressor per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a chamber" includes one or more of such outer chambers and reference to "a baffle" includes one or more of such baffles.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Illustrated in FIG. 1 is a firearm suppressor system 100. In accordance with one example of the present disclosure, the firearm suppressor system can comprise a firearm 120 and a firearm suppressor 110 coupled to a muzzle end 130 of the firearm, which is where a projectile, such as a bullet, and discharge gases exit the firearm upon firing. As described herein, the firearm suppressor can direct discharge gases backward relative to a direction of travel of the projectile past a baffle such that the discharge gases are at least temporarily trapped or sequestered behind the projectile to reduce or prevent alteration of a trajectory or a speed of the projectile by the discharge gases.

Figure 2A:
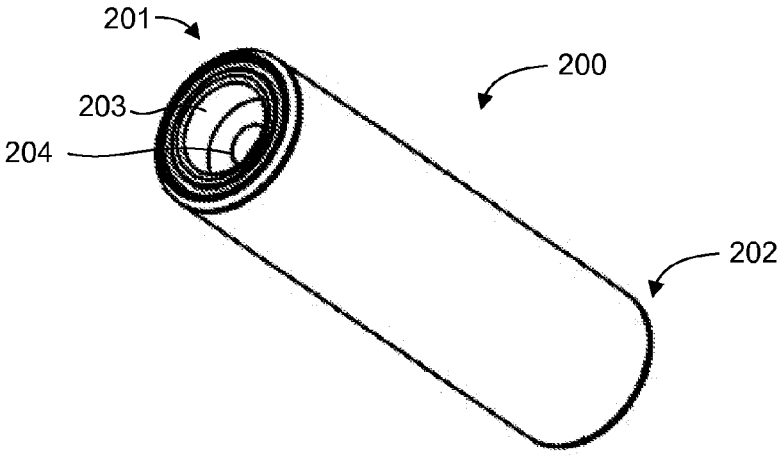
FIGS. 2A and 2B are perspective views of a firearm suppressor, in accordance with an example of the present disclosure.
Figure 2B:
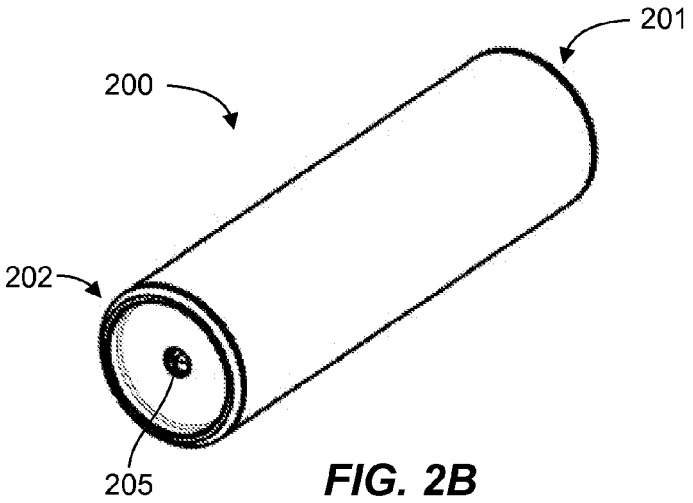

FIGS. 2A and 2B illustrate a firearm suppressor 200, in accordance with an example of the present disclosure. The firearm suppressor can include a projectile entrance end 201 and an exit end 202 opposite the entrance end. The entrance end can include a coupling feature 203 adapted to couple with a mating coupling feature of a firearm, which can be a threaded coupling although other coupling mechanisms can also be used (e.g. locking detents, channel-groove interface, cam and groove couplings, and the like). An entrance opening 204 of the firearm suppressor can be adapted to receive a projectile and discharge gases from the muzzle of the firearm. At the exit end, the firearm suppressor can have an exit opening 205 adapted to allow the projectile and discharge gases to exit the firearm suppressor.

FIGS. 3A-3E FIGS. illustrate several views of a core insert 350, which can be incorporated in a firearm suppressor as disclosed herein. The core insert can be adapted to be a permanent fixture within a firearm suppressor or exchangeable between a plurality of outer shells to accommodate a range of firearm calibers. In one aspect, the core insert can comprise a single unitary component, such as a single component manufactured from a single piece of stock material, which can increase longevity of the core insert. It should be recognized, however, that a core insert can be constructed in any suitable manner and can include any number of individual components or elements. The core insert can be made from any suitable material, such as carbon fiber, aluminum, titanium, steel, stainless steel, and the like. High temperature metal alloys such as, but not limited to, STELLITE, INCONEL, KOVAR, MONEL, and other high temperature alloys, or high nickel alloys can also be suitable.

Figure 3A:
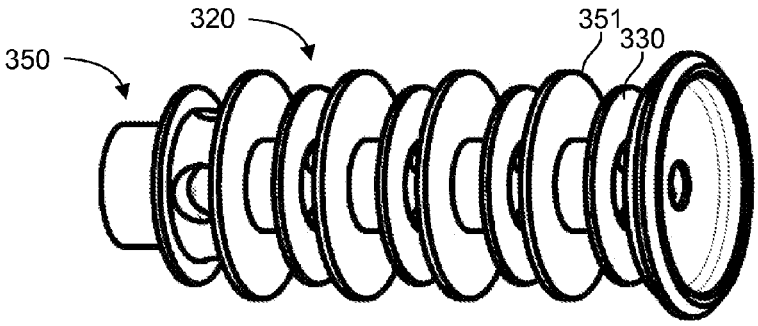
FIGS. 3A-3E are several views of a core of a firearm suppressor, in accordance with an example of the present disclosure.
Figure 3B:
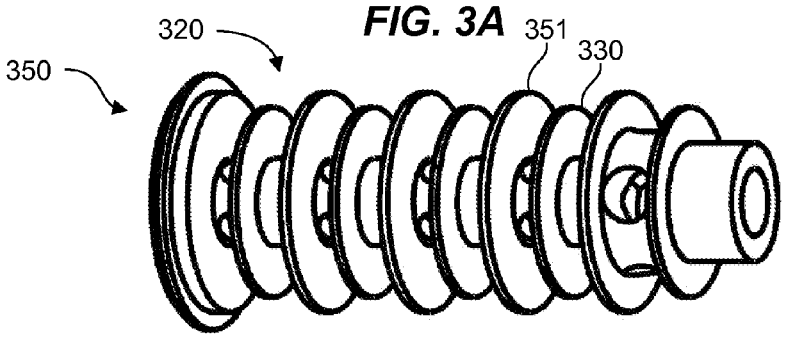
Figure 3C:
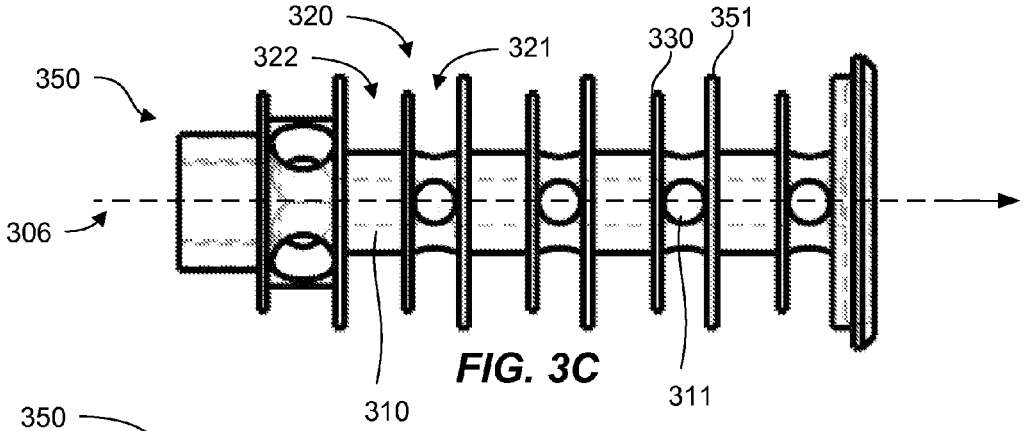
Figure 3D:
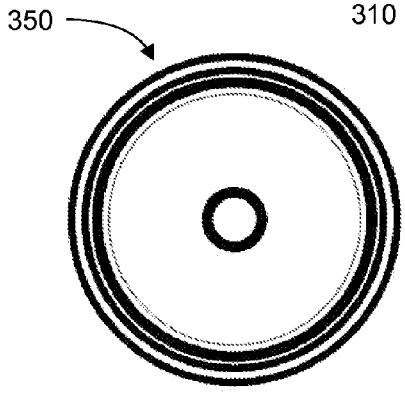
Figure 3E:
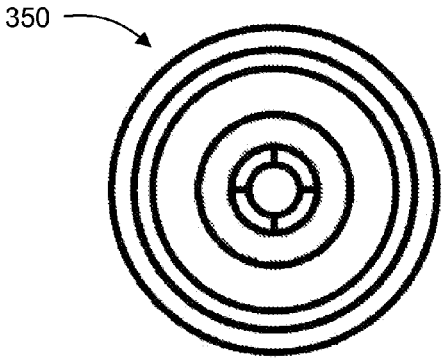

With particular reference to FIG. 3C, it can be seen that the core insert can include a central longitudinal chamber 310 adapted to facilitate passage of a projectile fired from a firearm through a firearm suppressor via the central longitudinal chamber. In one aspect, the central longitudinal chamber can comprise a cylindrical configuration. In a particular aspect, the cylindrical configuration can comprise a circular cross section, although any suitable cross-section can be incorporated. In another particular aspect, the central longitudinal chamber can exhibit a constant diameter along a longitudinal axis 306 of the central longitudinal chamber.

The core insert 350 can also include an outer chamber 320 disposed radially outward of the central longitudinal chamber 310. The outer chamber can be in fluid communication with the central longitudinal chamber via one or more openings 311. The core insert can also include a wall 351 disposed in the outer chamber forming part of the outer chamber or defining a boundary of the outer chamber. In one aspect the wall can form a forward boundary of the outer chamber. In another aspect, more than one wall can be used to form both forward and rearward boundaries of the outer chamber. In a further aspect, where the core insert has multiple outer chambers, a wall forming a forward boundary of one outer chamber can also form a rearward boundary of an adjacent chamber. Similarly, an outer shell (i.e. outer cylindrical casing) can be disposed and formed such that an outer perimeter of wall 351 meets an inner surface of the shell to form an outer peripheral wall of the outer chamber. The core insert can further include a baffle 330 disposed in the outer chamber and defining a forward portion 321 of the outer chamber and a rearward portion 322 of the outer chamber. In one aspect, the baffle can extend radially outward about the central longitudinal chamber, although the baffle can be of any suitable configuration to form a forward portion and a rearward portion of the outer chamber. In one aspect, for example, a baffle can include one or more holes or openings. Thus, the baffle can be adapted to segment or partition the outer chamber in any suitable manner. The forward portion of the outer chamber can contain the opening such that discharge gases associated with the projectile enter the forward portion of the chamber and are directed backward, generally opposite the direction of travel of the projectile, and past the baffle to the rearward portion of the outer chamber where the discharge gases are at least temporarily trapped behind the projectile to reduce or prevent alteration of a trajectory or a speed of the projectile by the discharge gases. In one aspect, the baffle can be substantially planar and oriented perpendicular to the longitudinal axis 306. Similarly, in one example, each outer chamber can be defined by two primary walls 351 and a single intermediate wall 330 oriented between the two primary walls. In one specific example, the intermediate wall 330 can be oriented closer to a primary wall adjacent the corresponding opening 311 than to the primary wall remote from the opening. Although not required, the intermediate wall can be a planar disc having a radius which is less than a radius of the primary walls such that an annular gap is formed. The annular gap allows fluid communication from a first portion of the outer chamber adjacent the opening 311 to a second remote portion of the outer chamber. In each case, the at least one opening is oriented in a forward portion of each outer chamber such that gases are directed backward through the outer chamber. In another aspect, the at least one openings can have a diameter greater than the bore diameter.

As shown in FIGS. 3A-3C, the core insert 350 can include multiple outer chambers, as described above, each in fluid communication with the central longitudinal chamber via an opening at the forward end of each chamber. In addition, a baffle can be disposed in one or more of the outer chambers such that the outer chambers can receive and, at least temporarily, trap discharge gases inside the outer chambers behind the projectile. In one aspect, the multiple outer chambers are fluidly isolated from one another, except via the openings at the forward end of each outer chamber and the central longitudinal chamber. Thus, discharge gases that enter the outer chambers can be trapped, at least temporarily, in the outer chambers, only exiting the outer chambers through the openings in which the gases entered each outer chamber. One benefit of this configuration may be little or no alteration of a trajectory or a speed of the projectile by the discharge gases, which can be diverted away from and behind the projectile by the structures described above. Compared to conventional firearm suppressors, projectile velocity for a firearm suppressor using a core insert as described herein, or an equivalently configured firearm suppressor, has been shown to increase from about 1% to about 1.5% with a reduction in standard deviation of velocity of up to about 20%. Comparison was made with standard design K-baffle suppressors and with unsuppressed barrels.

Figure 4A:
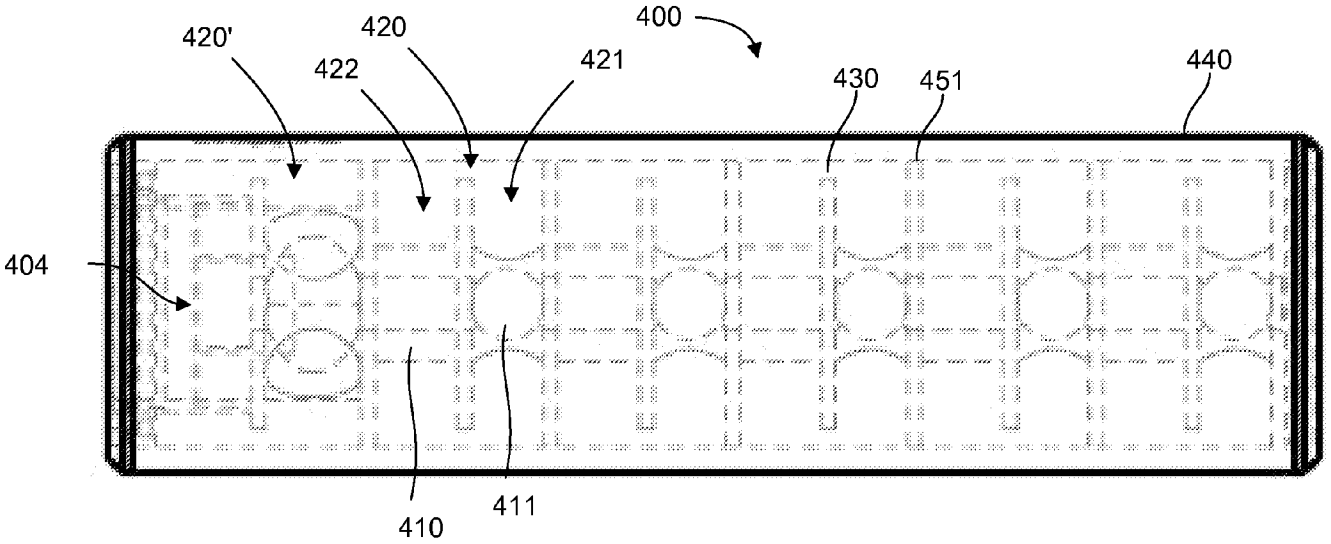
FIG. 4A is a side transparent view of one example of the firearm suppressor of the present disclosure.
Figure 4B:
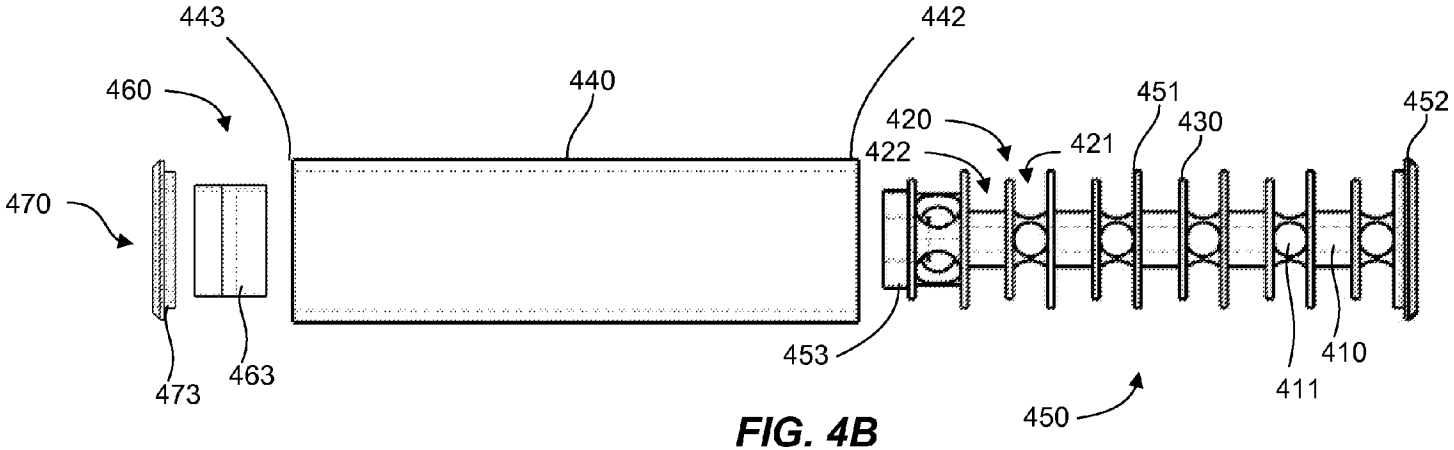
FIG. 4B is an exploded view of the firearm suppressor of FIG. 4A.

As previously discussed, a core insert can optionally be adapted to be removable to accommodate a range of firearm calibers (e.g. 5.56 mm, 6.8 mm, 7.62 mm, 5.45 mm, and the like). Thus, the core insert can be used as an exchangeable component of a firearm suppressor or as a permanent fixture of a firearm suppressor. One embodiment of a firearm suppressor using a core insert as described herein is illustrated in FIGS. 4A-4B. FIG. 4A illustrates a side transparent view of a firearm suppressor 400 that includes a core insert 450. In one aspect, the outer chamber or chambers of the firearm suppressor 400 can be adapted to be disposed substantially forward of a muzzle of the firearm. For example, as shown in FIG. 4A, the rearward-most outer chamber 420' of the firearm suppressor can be disposed, at least in part, radially outward of the central longitudinal chamber 410 proximate the entrance opening 404 of the central longitudinal chamber, and adapted to have little or no overlap with a muzzle of a firearm when coupled to the muzzle end of the firearm. Thus, in this configuration, the rearward-most outer chamber can be located substantially forward of the muzzle and can be adapted to have little or no overlap with the barrel and/or muzzle end of a firearm.

With reference to the exploded view of the firearm suppressor FIG. 4B, and with continued reference to FIG. 4A, the outer chamber 420 can be formed, at least in part, by an outer shell 440. The outer shell can be constructed of any suitable material, such as steel, aluminum, nickel, titanium, carbon fiber, metal matrix composites, etc. Carbon fiber can be advantageous for heat dissipation. In one aspect, the central longitudinal chamber 410, the baffle 430, and a portion of the outer chamber can be formed by a core insert 450 adapted to be disposed inside the outer shell. The baffle can define a forward portion 421 and a rearward portion 422 of the outer chamber. The core insert can include one or more walls 451 adapted to form at least a portion of the outer chamber or chambers. The one or more walls can be adapted to fit inside the outer shell such that gas flow between the walls and the outer shell is prevented or minimized. Thus, in one aspect, the walls can form a seal with the outer shell. Where there are multiple outer chambers, the outer chambers can be fluidly isolated from one another, except via the openings 411 at the forward portion 421 of each outer chamber and the central longitudinal chamber. Thus, discharge gases that enter the outer chambers can be trapped, at least temporarily, in the outer chambers, only exiting the outer chambers through the openings in which the gases entered each outer chamber.

The outer shell 440 and the core insert can be secured to one another at the exit end via coupling features 442, 452, respectively, which can be a threaded coupling, a locking detent coupling, channel-groove interface, a cam and groove coupling, or the like. At the entrance end, an entrance end portion can comprise a sleeve 460 adapted to fit within the outer shell and to form, at least in part, the rearward-most outer chamber 420'. The sleeve and the core insert can be adapted to couple with one another via coupling features 463, 453, respectively, which can be a threaded coupling, a locking detent coupling, channel-groove interface, a cam and groove coupling, or the like. In one aspect, the sleeve can also be adapted to facilitate coupling with a firearm, such as via a coupling as mentioned above. Additionally, an entrance end cap 470 can be adapted to secure the sleeve within the outer shell and to form a portion of the rearward-most outer chamber. The entrance end cap and the outer shell can be adapted to couple with one another via coupling features 473, 443, respectively, which can be a threaded coupling, a locking detent coupling, channel-groove interface, a cam and groove coupling, and the like.

Figure 5A:
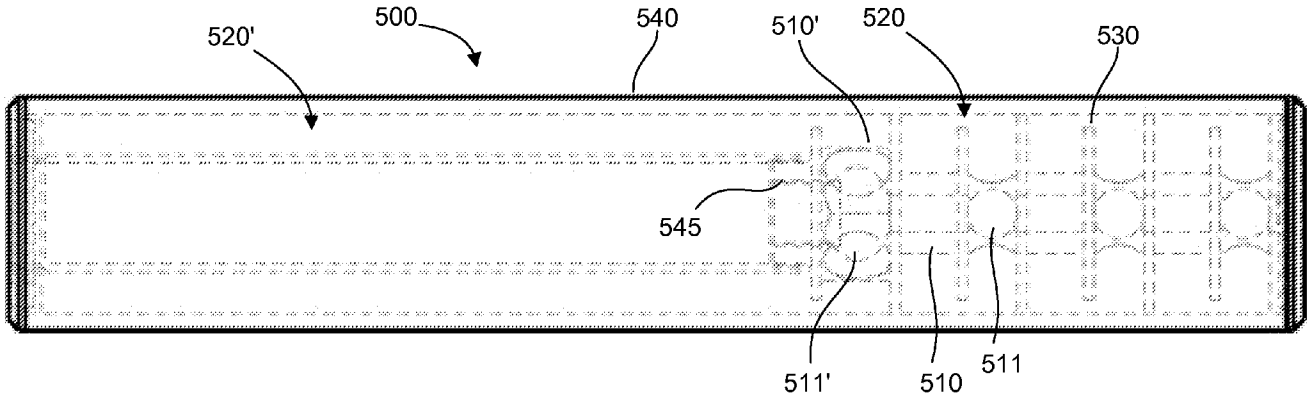
FIG. 5A is a side transparent view of a firearm suppressor, in accordance with another example of the present disclosure.
Figure 5B:
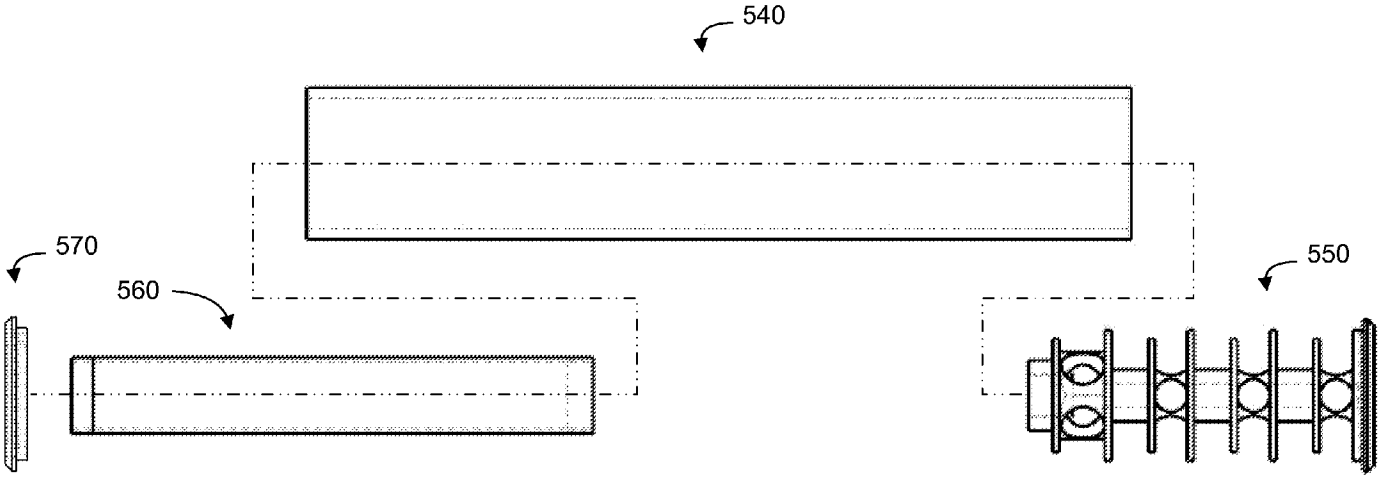
FIG. 5B is an exploded view of the firearm suppressor of FIG. 5A.

FIGS. 5A and 5B illustrate a firearm suppressor 500, in accordance with another example of the present disclosure. The firearm suppressor 500 is similar to the firearm suppressor 400 of FIGS. 4A-4B in many respects. For example, the firearm suppressor 500 can include a central longitudinal chamber 510, an outer chamber 520 in fluid communication with the central longitudinal chamber via an opening 511, and a baffle 530, such that the outer chamber can receive and, at least temporarily, trap discharge gases inside the outer chamber behind the projectile. In addition, the firearm suppressor 500 can include an outer shell 540, a core insert 550, a sleeve 560, and an entrance end cap 570. In this case, however, the firearm suppressor 500 can be adapted such that a rearward-most outer chamber 520' is disposed substantially radially outward of a barrel of a firearm. For example, the rearward-most outer chamber can be disposed, at least in part, radially outward of the central longitudinal chamber proximate an entrance opening 504 of the central longitudinal chamber, and adapted to have substantial overlap with a muzzle and/or a barrel of a firearm when coupled to the muzzle end of the firearm. Openings 511' can be oriented within a cylindrical wall 510'. Notably, cylindrical wall 510' can have a diameter which aligns with and is adjacent to the muzzle end of the barrel. In this case, the cylindrical wall has a larger diameter than forward corresponding walls. Similarly, intermediate wall 530' can be oriented within the rearward outer chamber 520' adjacent the openings. Thus, in this configuration, the rearward-most outer chamber can be adapted to extend back over the firearm muzzle. Although the rearward-most outer chamber can extend over the barrel any length, lengths often run from 1 to 16 inches, and in some cases 5 to 11 inches. Such a configuration can be achieved, for example, by having an elongated sleeve 560 to fit within the outer shell and form a portion of the rearward-most outer chamber. In this example, the coupling portion of the firearm suppressor contacts the firearm muzzle and a gap is maintained between the firearm barrel and rearward portions of the suppressor. The suppressor can include a muzzle coupling feature 545 which is adapted to couple with a corresponding muzzle end of a firearm. Although any suitable coupling feature can be used, non-limiting examples include threads, locking detents, channel-groove interface, cam and groove couplings, and the like. The increased volume provided by the enlarged rearward-most outer chamber, compared to that of the firearm suppressor 400 of FIGS. 4A-4B, can accumulate and/or accommodate a higher volume of discharge gases to ensure that enough discharge gases are diverted away from and behind the projectile so that speed and/or trajectory of the projectile are not affected by the firearm suppressor and additional acoustic suppression can be obtained. Such a configuration may be beneficial for higher powered bullets, which typically produce more discharge gases than smaller, less powerful bullets.

Though FIGS. 5A-5B illustrate an alternative embodiment of a core insert compared to that illustrated in FIGS. 4A-4B, core insert 450 could also be used with outer shell 540 and a variety of other outer shells as an exchangeable core insert or as a permanent fixture of a firearm suppressor. Similarly, core insert 540 could be used with outer shell 440 and a variety of other outer shells as an exchangeable core insert or as a permanent fixture of a firearm suppressor. Other core inserts with different numbers of outer chambers could also be used with outer shells 440, 540, and other shells as exchangeable core inserts or as a permanent fixture of firearm suppressor. Varying sleeves, outer shells, core inserts, and couplings can be used to accommodate a large variety of combinations of firearm suppressors based on the current technology.

Figure 6A:
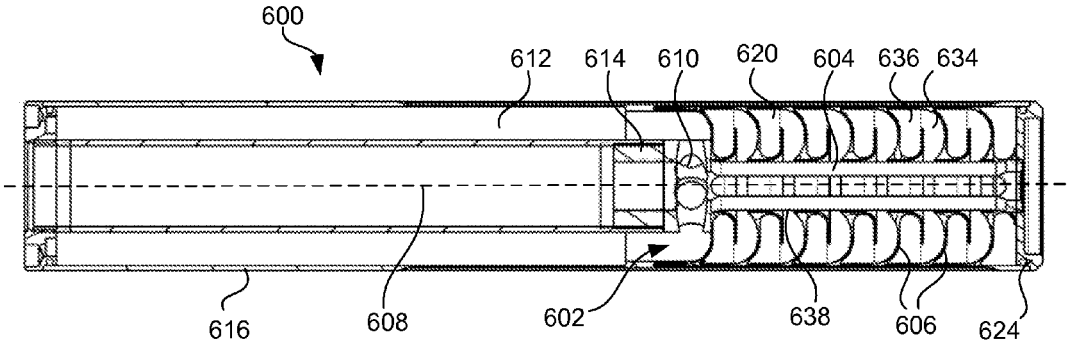
FIG. 6A is a side cross-sectional view of firearm suppressor, in accordance with another example of the present disclosure.
Figure 6B:
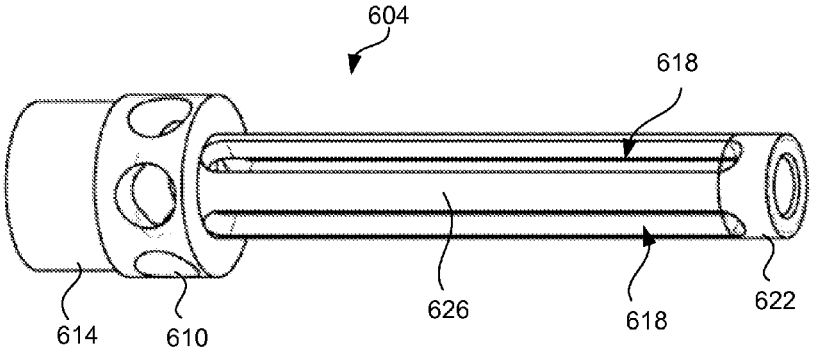
FIG. 6B is a side perspective view of a core body of FIG. 6A.

In one optional aspect, FIG. 6A shows a firearm suppressor 600 including a core insert 602 having a core body 604 with a plurality of wall units 606 oriented along a longitudinal axis 608 of the firearm suppressor. Referring to FIG. 6B, the core body 608 can have an inlet portion 610 which fluidly connects to a rearward-most outer chamber (e.g. 612 shown in FIG. 6A) and allows passage of gas from the central longitudinal chamber into the rearward-most chamber 612. Although inlet openings can be radially distributed about the inlet portion, other openings can be used. For example, slits, rectangular openings, elliptical openings, and the like. The core body can also include a coupling portion 614 adapted to couple with a suppressor housing 616 and a muzzle end of a firearm. The core body can also include an optional end portion 622 adapted to couple with an end cap 624 and/or provide additional stability to core stems 626 which define longitudinal slits 618.

As can be seen most clearly in FIG. 6B the core body 604 can include longitudinal slits 618 running a length of the core body. These slits provide access of gases from the central longitudinal chamber into outer chambers 620. In one example, four such slits can be oriented 90 degrees from one another, although any number of slits can be used. For example three to twelve, and in some case four to six longitudinal slits can be used. Depending on a width of each slit interior surfaces of the may form segmented circles or even can be eliminated entirely if slit widths exceed a bore diameter of the central longitudinal chamber. Regardless, longitudinal slits can provide increased gas flow into outer chambers.

Figure 6C:
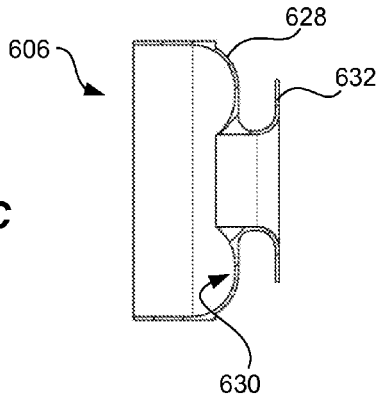
FIG. 6C is a side cross-sectional view of a wall unit of FIG. 6A.

Walls within the core insert 602 can be formed as described above with respect to other embodiments. For example, planar disc walls can be oriented in series along a length of the core insert having alternating outer disc diameters (e.g. FIGS. 3C and 4B). However, as illustrated in FIG. 6C, wall units 606 can have contoured surfaces which direct gases rearward as described previously. Wall units 606 can include a primary wall surface 628 which defines a rear-most surface of one outer chamber volume and a front-most surface of an adjacent outer chamber volume. In this example, the primary wall surface has a forward surface 630 which curves forward to form a concave portion which curves rearward toward outer edges of the wall unit. An intermediate wall surface 632 can be oriented forward of the primary wall surface to define a boundary between forward portions 634 and rearward portions 636 of outer chambers 620. In one aspect, the intermediate wall surface can be planar, although other contoured surfaces can be used. Wall units 606 can be spaced apart to form inlets 638 which fluidly communicate with the aforementioned longitudinal slits 618 to allow gases into the forward portion 634 of the outer chamber 620.

As can be seen, at least two wall units can be used to define outer chambers. Such wall units can be secured in place using any suitable mechanism which can be either permanent or removable. For example, wall units 606 can be slid onto core body 604 and maintained in place via end cap 624 which abuts a forward-most wall unit. Alternatively, wall units can be secured via threading, locking mechanisms, welding, or integrally formed from a common piece with the core body (e.g. 3D printing).

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A firearm suppressor, comprising:

a central longitudinal chamber adapted to facilitate passage therethrough of a projectile fired from a firearm;

a plurality of outer chambers disposed radially outward of the central longitudinal chamber, each of the plurality of outer chambers being in direct fluid communication with the central longitudinal chamber via respective openings, but otherwise being fluidly isolated from one another; and a baffle disposed in each of the plurality of outer chambers and defining a forward portion of each of the plurality of outer chambers and a rearward portion of each of the plurality of outer chambers, wherein the forward portion of each of the plurality of outer chambers contains the respective opening such that discharge gases associated with the projectile entering the forward portion of any of the plurality of outer chambers are directed backward past the baffle to the rearward portion of the outer chamber where the discharge gases are at least temporarily trapped behind the projectile to reduce or prevent alteration of a trajectory or a speed of the projectile by the discharge gases.

2. The firearm suppressor of claim 1, wherein the central longitudinal chamber comprises a cylindrical configuration.

3. The firearm suppressor of claim 2, wherein the cylindrical configuration comprises a circular cross section.

4. The firearm suppressor of claim 1, wherein the central longitudinal chamber has a constant diameter along a longitudinal axis of the central longitudinal chamber.

5. The firearm suppressor of claim 1, wherein the plurality of outer chambers are formed, at least in part, by an outer shell.

6. The firearm suppressor of claim 5, wherein the central longitudinal chamber, the baffle, and a portion of the plurality of outer chambers are formed by a core insert adapted to be removably disposed inside the outer she to allow the core insert to be interchangeable with a second core insert of a different caliber.

7. The firearm suppressor of claim 6, wherein the core insert comprises a single unitary component.

8. The firearm suppressor of claim 1, wherein the baffle extends radially outward about the central longitudinal chamber.

9. The firearm suppressor of claim 1, wherein each of the respective openings comprises a plurality of openings.

10. The firearm suppressor of claim 1, wherein the plurality of outer chambers are disposed, at least in part, radially outward of the central longitudinal chamber proximate an entrance opening of the central longitudinal chamber.

11. The firearm suppressor of claim 10, wherein the plurality of outer chambers are adapted to be disposed substantially radially outward of a barrel of the firearm.

12. The firearm suppressor of claim 1, wherein the plurality of outer chambers are adapted to be disposed substantially forward of a muzzle of the firearm.

13. The firearm suppressor of claim 10, further comprising an entrance end portion adapted to facilitate coupling with the firearm and to form, at least in part, the plurality of outer chambers.

14. The firearm suppressor of claim 1, wherein each of the respective openings of the plurality of outer chambers is disposed at a particular longitudinal position within each of the plurality of outer chambers such that there is no additional opening positioned longitudinally forward or aft of the respective opening within a particular outer chamber.

15. The system of claim 4, wherein the baffle is planar and oriented perpendicular to the longitudinal axis.

16. A firearm suppressor system, comprising:

a firearm; and a firearm suppressor adapted to couple to a muzzle end of the firearm, having a central longitudinal chamber adapted to facilitate passage therethrough of a projectile fired from the firearm, a plurality of outer chambers disposed radially outward of the central longitudinal chamber, each of the plurality of outer chambers being in direct fluid communication with the central longitudinal chamber via respective openings, but otherwise being fluidly isolated from one another, and a baffle disposed in each of the plurality of outer chambers and defining a forward portion of each of the plurality of outer chambers and a rearward portion of each of the plurality of outer chambers, wherein the forward portion of each of the plurality of outer chambers contains the respective opening such that discharge gases associated with the projectile entering the forward portion of any of the plurality of outer chambers are directed backward past the baffle to the rearward portion of the outer chamber where the discharge gases are at least temporarily trapped behind the projectile to reduce or prevent alteration of a trajectory or a speed of the projectile by the discharge gases.

17. The system of claim 16, wherein the plurality of outer chambers are disposed, at least in part, radially outward of the central longitudinal chamber proximate an entrance opening of the central longitudinal chamber.

18. The system of claim 17, wherein the plurality of outer chambers are disposed substantially radially outward of a barrel of the firearm.

19. The system of claim 16, wherein the plurality of outer chambers are disposed substantially forward of the muzzle of the firearm.

20. The system of claim 16, wherein the central longitudinal chamber comprises a cylindrical configuration.

21. The system of claim 16, wherein the central longitudinal chamber has a constant diameter along a longitudinal axis of the central longitudinal chamber.

22. The system of claim 16, wherein each of the respective openings of the plurality of outer chambers is disposed at a particular longitudinal position within each of the plurality of outer chambers such that there is no additional opening positioned longitudinally forward or aft of the respective opening within a particular outer chamber.

* * * * *